US007284518B2

(12) United States Patent
Romblom

(10) Patent No.: US 7,284,518 B2
(45) Date of Patent: Oct. 23, 2007

(54) DRIVE PLATE ASSEMBLY AND METHOD OF ASSEMBLING A POWERTRAIN

(75) Inventor: Edward R. Romblom, De Witt, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/375,495

(22) Filed: Mar. 14, 2006

(65) Prior Publication Data

US 2007/0056543 A1 Mar. 15, 2007

Related U.S. Application Data

(60) Provisional application No. 60/716,593, filed on Sep. 13, 2005.

(51) Int. Cl.
*F01L 1/02* (2006.01)

(52) U.S. Cl. ..... 123/90.31; 123/195 A; 123/198 R

(58) Field of Classification Search ..... 123/90.31, 123/195 A, 198 R
See application file for complete search history.

(56) References Cited

U.S. PATENT DOCUMENTS

| | | | | |
|---|---|---|---|---|
| 4,573,439 A * | 3/1986 | Kasting | ..... | 123/195 A |
| 6,013,016 A * | 1/2000 | Irvine et al. | ..... | 483/1 |
| 2005/0016490 A1 * | 1/2005 | Stone | ..... | 123/195 A |

* cited by examiner

*Primary Examiner*—Zelalem Eshete

(57) ABSTRACT

A drive plate assembly includes a plate member adapted for mounting to an engine block. The plate member has first and second gears mounted thereto such that they intermesh. The backlash of the gears is predetermined by mounting to the plate member and unaffected by mounting the plate member to the engine block. A method of assembling a powertrain is also provided.

8 Claims, 4 Drawing Sheets

DRIVE PLATE ASSEMBLY AND METHOD OF ASSEMBLING A POWERTRAIN

CROSS-REFERENCE TO RELATED APPLICATIONS

This application claims the benefit of U.S. Provisional Application No. 60/716,593, filed Sep. 13, 2005, which is hereby incorporated by reference in its entirety.

TECHNICAL FIELD

This invention relates to a drive plate assembly mountable to an engine block and to a method of assembling a powertrain.

BACKGROUND OF THE INVENTION

In addition to propelling a vehicle, power from an engine crankshaft may be used to drive one or more vehicle accessory systems, such as an engine lubrication oil pump. If one or more gear drives is used to transfer power to the vehicle accessory system(s), assembly of the gear drives is critical in controlling gear backlash. As used herein, a "gear drive" is a set of one or more intermeshing gears.

SUMMARY OF THE INVENTION

A drive plate assembly is provided that includes a plate member and has first and second intermeshing gears rotatably mounted with respect to the plate member. The gears and plate member are preassembled so that the backlash (i.e., build variation or dimensional tolerance) of the first and second gears is predetermined, i.e., controlled, by mounting of the gears to the plate member. The plate member is then mounted to an engine block. Backlash of the gears is unaffected by mounting the plate member to the engine block. The drive plate assembly avoids the problem of mounting each gear separately to the engine block and the potential variability in centerline distance (and therefore backlash) between the first and second gears that may occur with separate mountings. Preferably, the plate member is mounted so that the first gear is concentric with an opening of a bore running through the engine block. A rotatable shaft will be supported by the engine block within the bore for driving the first gear. The bore may begin from the other end of the engine block to ensure proper backlash of a set of intermeshing gears at the other end of the bore that are operatively connected to the rotatable shaft at that end. Because backlash of the gears of the drive plate assembly is not dependent upon the location of the bore opening, backlash of the gear sets at both ends is optimized, i.e., backlash of the gear set at the other end does not affect backlash of the first and second gears on the plate member.

An engine assembly includes an engine block with an opening for supporting a rotatable shaft. The plate member is adapted for mounting to the engine block. First and second gears are rotatably mounted with respect to the plate member so that the gears intermesh with one another. The plate member mounts to the engine block so that the first gear is substantially concentric with the rotatable shaft and the rotatable shaft powers the second gear via the first gear.

A method of assembling a powertrain includes mounting a first gear and a second gear to a plate member such that the gears intermesh. After mounting of the gears to the plate member, the plate member is mounted to an engine block so that the first gear is aligned with a rotatable drive member (such as a rotatable shaft). The rotatable member is at least partially supported by the engine block for powering the second gear via the first gear. The method may include machining an opening through the engine block that the rotatable drive member will extend through.

The above features and advantages and other features and advantages of the present invention are readily apparent from the following detailed description of the best mode for carrying out the invention when taken in connection with the accompanying drawings.

DESCRIPTION OF THE PREFERRED EMBODIMENT

Figure 1:
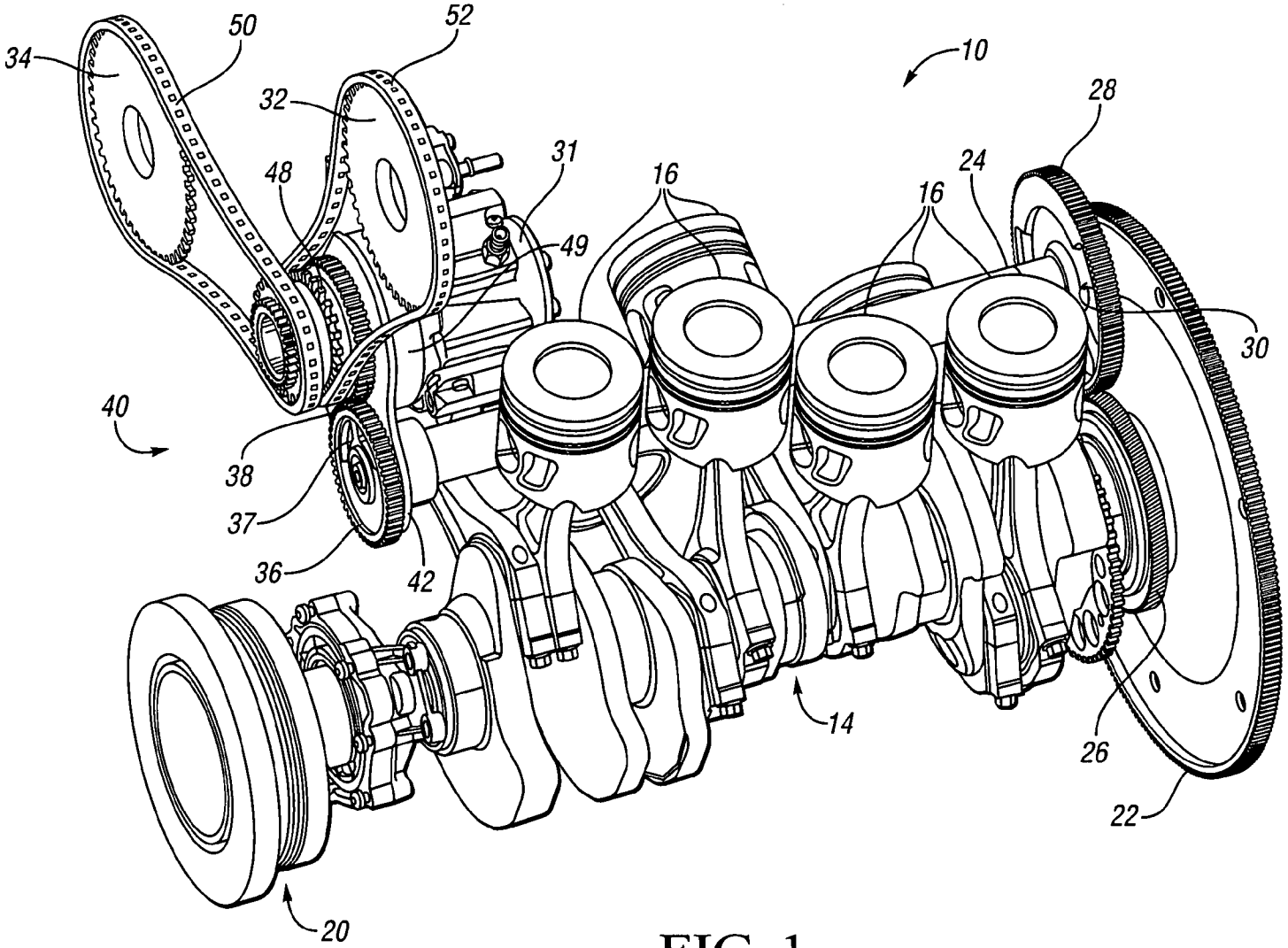
FIG. 1 is a schematic perspective illustration of various engine components including a crankshaft and a balance transfer shaft with a drive plate assembly attached at one end of the balance transfer shaft.
Figure 3:
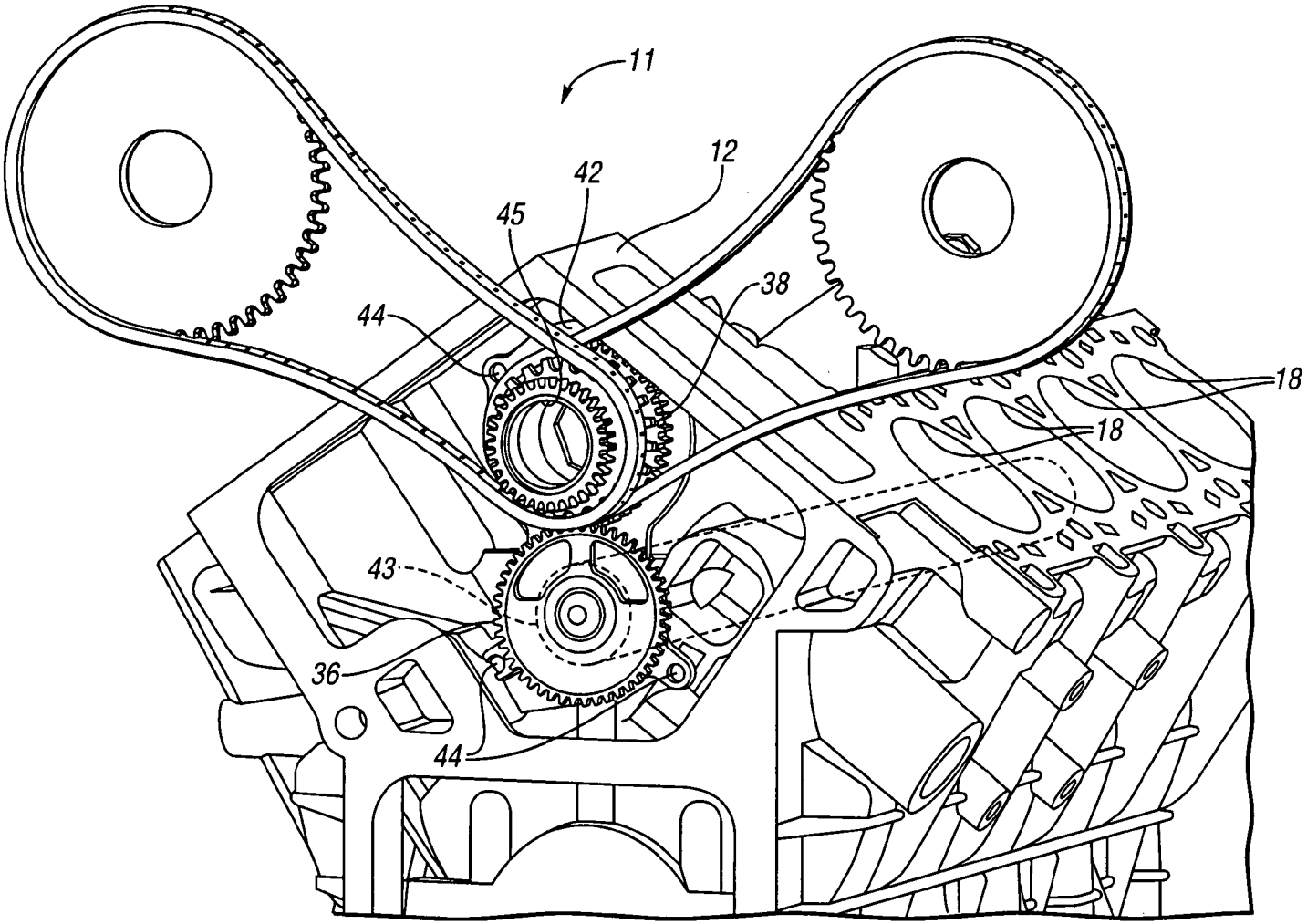
FIG. 3 is a schematic perspective illustration of the drive plate assembly of FIGS. 1 and 2 shown mounted to an engine block.

Referring to the drawings, wherein like reference numbers refer to like components, FIG. 1 shows selected components of a diesel engine 10 which is part of an engine assembly 11 (shown in FIG. 3). An engine block 12 (not shown in FIG. 1, but shown and described with respect to FIG. 3) houses many of the components. A crankshaft 14 is turned by movement of pistons 16 within cylinder bores 18 of the engine block 12 (as shown in FIG. 3), as is commonly understood. Periodic reciprocating movement of the pistons 16 causes torsional, lateral and vertical vibration forces upon the engine 10. A torsional damper 20 as well as a flywheel 22 operatively connected with the crankshaft 14 help to alleviate the torsional and lateral forces.

Figure 2:
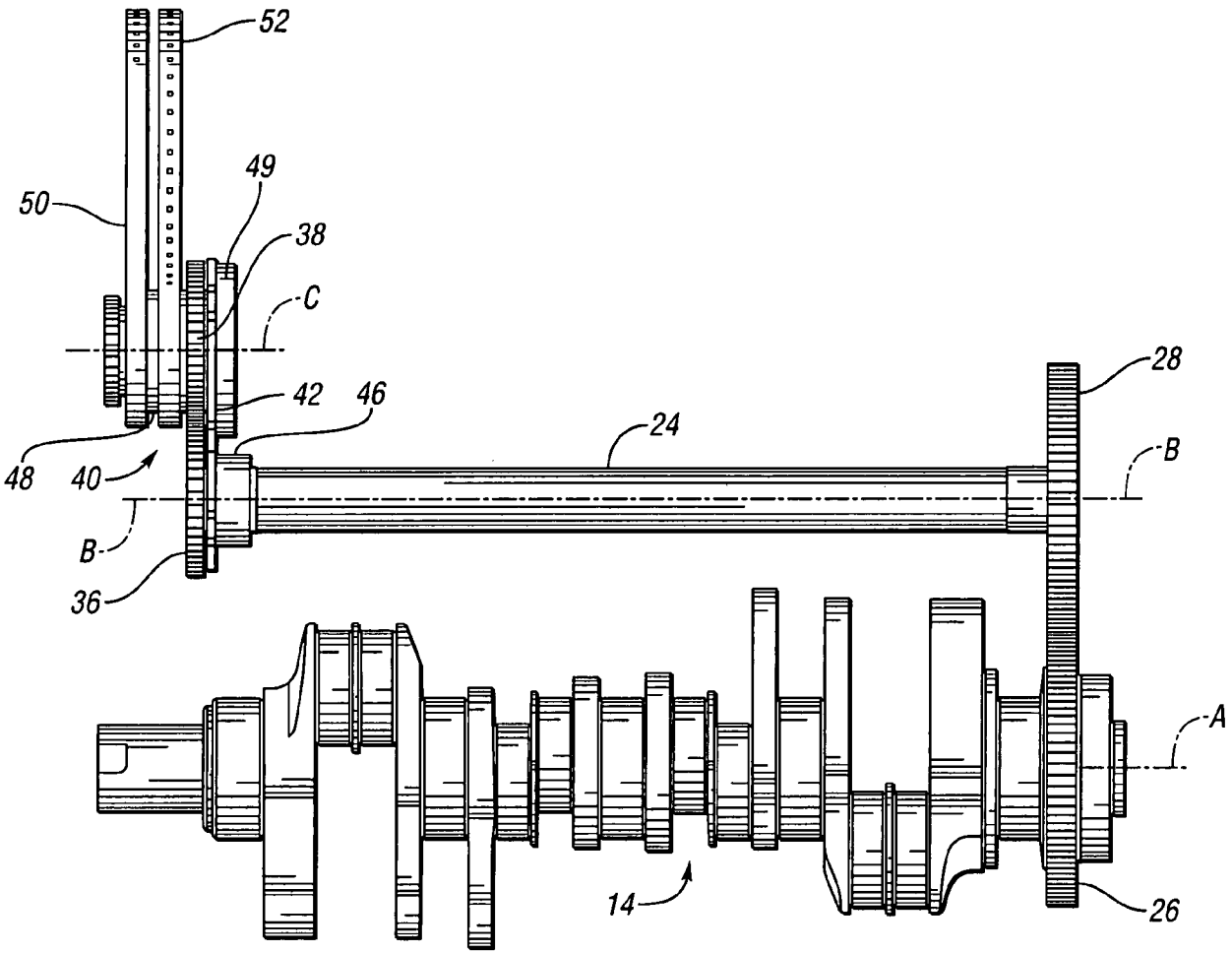
FIG. 2 is a side illustration of the crankshaft, balance transfer shaft and drive plate assembly of FIG. 1.

A balance transfer shaft 24 is radially-spaced and substantially parallel with an effective centerline A of the crankshaft 14 (centerline A shown in FIG. 2). The balance transfer shaft 24 runs generally parallel with and is driven by the crankshaft 14. The balance transfer shaft 24 counteracts engine vibration, such as vertical vibration forces caused by reciprocating movement of the pistons 16 and connecting rods (not shown) as well as by rotation of the crankshaft 14. The balance transfer shaft 24 is also referred to herein as a rotatable drive member. A drive gear 26 is connected for common rotation with the crankshaft 14. The drive gear 26 intermeshes with and drives a weighted transfer gear 28 connected at one end of the transfer shaft 24. The drive gear 26 and weighted transfer gear 28 may be referred to as a rear end gear set 26, 28. The weighted transfer gear 28 preferably includes one or more openings 30 formed or cut in one half of the gear (the lower half as shown in FIG. 1) such that the weighted transfer gear 28 creates a torque when rotated. The torque of the weighted transfer gear 28 counteracts the engine vibrations.

Referring to FIG. 2, the distance between the effective centerline A of the crankshaft and a centerline B of the balance transfer shaft 24 is critical: any excess dimensional play between these centerlines will negatively affect "gear backlash", i.e., the dimensional tolerance or tightness of the intermeshing gears 26, 28. Less than optimal backlash (i.e., due to the centerlines A and B being too close to one another) could cause gear and bearing failure while excessive backlash (i.e., due to the centerlines A and B being too far apart) causes noise. Both the crankshaft 14 and the balance transfer shaft 24 are supported by bearings (not shown) at bore openings at the rear of the engine block 12; controlling the location of these bore openings with respect to one another is critical as it determines the location of the centerlines A and B and hence backlash of the rear end gear set 26, 28.

Referring again to FIG. 1, in addition to counteracting engine vibration forces, the balance transfer shaft 24 may be used to drive a variety of vehicle components or systems. In this embodiment, the transfer shaft 24 drives overhead camshafts (not shown) via first and second camshaft gears 32, 34, respectively, as well as a hydraulic fuel injection pump 31, as described below. Torque is transferred from the balance transfer shaft 24 to these systems via a first gear 36 that intermeshes with a second gear 38. The first and second gears may be referred to as a front end gear set 36, 38. The first gear 36 is connected for common rotation with the balance transfer shaft 24 and is formed with openings 37 such that it is weighted and creates a rotational torque, similar to weighted transfer gear 28. The effective torque of the first gear 36 is radially opposed to the effective torque of the weighted transfer gear 28.

Referring to FIG. 2, achieving optimal backlash of intermeshing first and second gears 36, 38 depends on controlling the relative location of a centerline C of the second gear 38 with respect to the centerline B of the first gear 36. (The centerline B of the first gear 36 is substantially the same as the centerline of the weighted transfer gear 28 as both are substantially aligned with the transfer shaft 24.) However, if in order to control backlash of the rear end gear set 26, 28, the transfer shaft bore (43 in FIG. 3) through the engine block 12 for supporting the transfer shaft 24 is machined from the rear of the engine block (i.e., the end near the rear end gear set 26, 28) the centerline accuracy of the front balance shaft bore opening (i.e., the opening at the end of the bore 43 near the front end gear set 36, 38) relative to other front end locations (such as the location of centerline C) may be compromised.

In order to solve the problem of ensuring accurate intermeshing of gear sets at both ends of the balance transfer shaft 24, the first and second gears 36, 38 are preassembled as part of a drive plate assembly 40. The drive plate assembly 40 includes the first and second gears 36, 38 as well as a plate member 42. Bearings and bushings used to allow rotation of the gears 36, 38 with respect to the plate member 42 may also be included in the plate assembly 40. Specifically, the drive plate assembly 40 is preassembled by first mounting first and second gears 36, 38 to the plate member 42. The plate member 42 is then positioned at a front-end opening (indicated in phantom in FIG. 3) of the balance shaft bore 43 through the engine block 12. The plate member 42 is then mounted to the engine block 12. No separate opening in the engine block 12 is required at the front end for the second gear 38 (because the second gear 38 is secured to the plate member 42 rather than directly to the engine block 12); thus, centerline accuracy of the rear end of the transfer shaft bore may be maintained without effect on backlash of the front end gear set 36, 38 relative to one another. The backlash of the front end gear set 36, 38 is controlled by the preassembled plate assembly 40, i.e., the mounting of the first and second gears 36, 38 to the plate member 42, and does not depend upon the location of the front end opening of the balance transfer shaft bore 43. The engine assembly 11 of FIG. 3 includes the engine block 12, the balance transfer shaft 24 (visible in FIGS. 1 and 2) and the drive plate assembly 40. It may also include a vehicle component such as the pump 31 (visible in FIG. 1) and/or the first and second overhead camshaft gears 32, 24.

Figure 5:
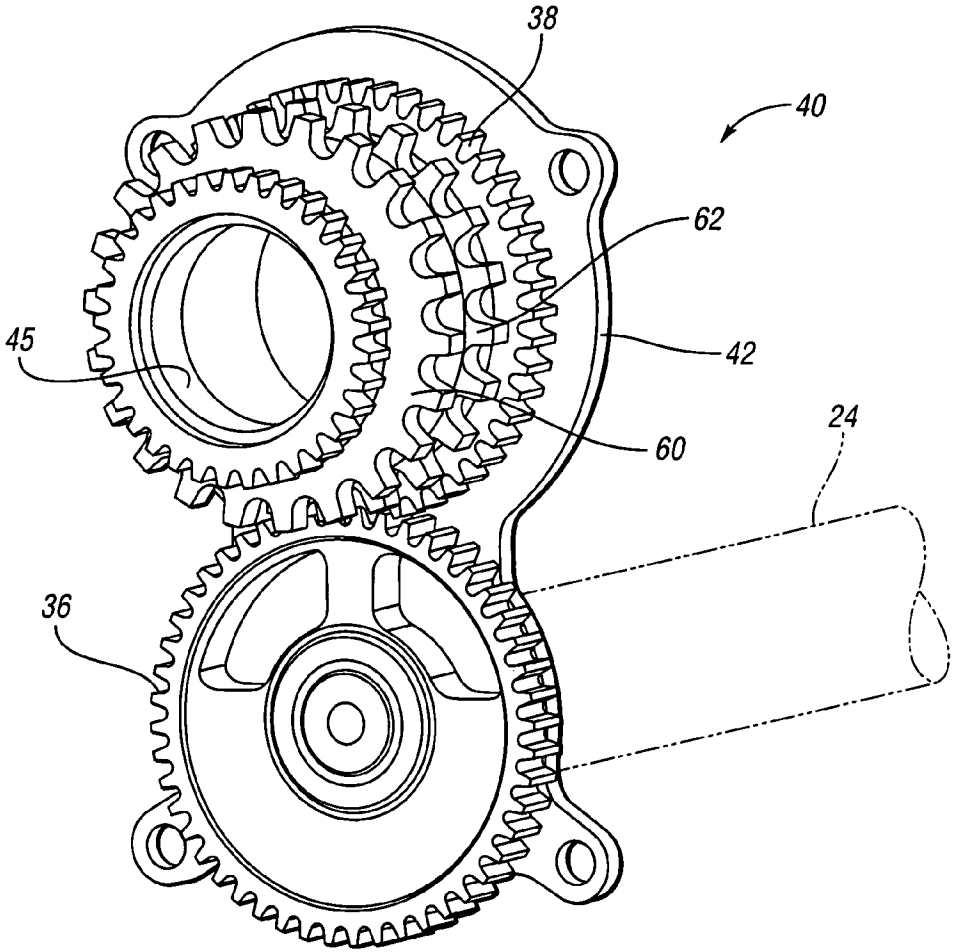
FIG. 5 is a schematic representation of a plate member included in the drive plate assembly of FIGS. 1 through 4.
Figure 4:
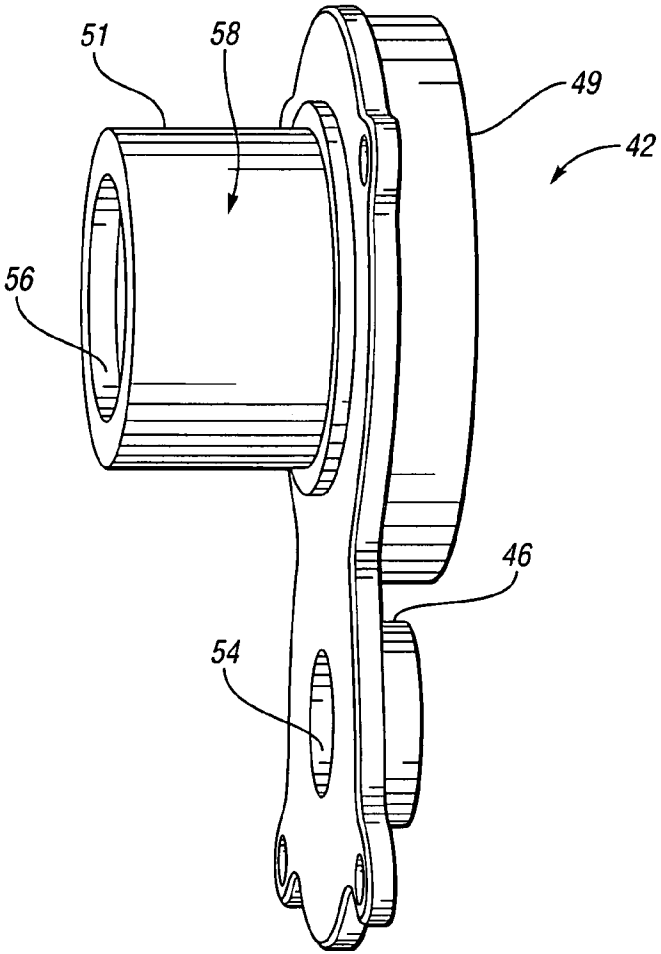
FIG. 4 is a schematic representation of the drive plate assembly of FIGS. 1 through 3.

Referring to FIG. 3, the plate member 42 has fastener openings 44 formed or otherwise cut therein. (One fastener opening is obscured by the engine block 12 in FIG. 3, but is located symmetrically opposite the uppermost fastener opening 44 shown at the upper left of the plate member 42. The smaller image of the plate member 42 of FIG. 1 does not show the detail of the fastener openings 44; however, the fastener openings 44 exist in the plate member 42 as shown in FIGS. 3-5.) Threaded bolts (not shown) or other suitable fastening mechanisms may be received through the fastener openings 44 to secure the plate member 42 to the engine block 12. Referring again to FIG. 2, it is evident that the plate member 42 is formed with a first cylindrical flange portion 46. The flange portion 46 houses a bearing (not shown) to support the transfer shaft 24 and the first gear 36 for common rotation with respect to the flange portion 46. A bushing (not shown) may be spaced between the cylindrical flange portion 46 and the front end opening of the transfer shaft bore 43 (shown in FIG. 3). The end of the transfer shaft 24 may be splined to mate with internal splines of the first gear 36. A bolt or other fastening device may secure the first gear 36 on the end of the transfer shaft 24. The cylindrical flange portion 46 is piloted into the front-end opening of the transfer shaft bore 43 (see FIG. 3) prior to fastening the plate member 42 to the engine block 12. The first gear 36 is concentric with the front-end opening of the transfer shaft bore 43, and thus with the transfer shaft 24 when the drive plate assembly 40 is secured to the engine block 12.

As is also apparent in FIG. 2, the second gear 38 is connected for common rotation with a spindle 48. In this embodiment the second gear 38 and spindle 48 are unitary and integrated; within the scope of the invention, they may also be separate components. First and second rotatable transfer devices, which in this embodiment are chains 50, 52, are connected between the spindle 48 and the first and second overhead cam shaft gears 32, 34, respectively (shown in FIG. 1), to create a chain drive for transferring drive power from the spindle 48 to the camshafts (not shown). Additionally, the pump 31 is supported at an opening 45 (shown in FIGS. 3 and 5) in the second gear 38 and is driven by rotation of the second gear 38. The pump 31 may be splined or otherwise secured for rotation with the second gear 38 and spindle 48. The plate member 42 has a second cylindrical flange portion 49 to partially house and support the pump 31 at the second gear 38. In an alternative embodiment, the pump 31 may be secured to the second gear 38 forward of the spindle 48. Additionally, the pump 31 may instead be radially spaced from the spindle 48 and driven via a chain, similar to the overhead camshafts, in which event the second cylindrical flange portion 49 would not be necessary.

Referring to FIG. 4, the plate member 42 with first cylindrical flange portion 46 and second cylindrical flange portion 49 is depicted. A third cylindrical flange portion 51 extends opposite and concentric with the second cylindrical flange portion 49. A first opening 54 in the plate member 42 is concentric with and supports the transfer shaft 24 and the first gear 36, as depicted in FIG. 1. A second opening 56 in the plate member 42 is concentric with the second gear 38 and spindle 48 shown in FIG. 2, which are supported for rotation about an outer surface 58 of the third cylindrical flange portion 51.

Referring to FIG. 5, the drive plate assembly 40 includes plate member 42, first gear 36 and second gear 38. The desired backlash of the intermeshing first gear 36 and second gear 38 is controlled by the mounting of the gears 36, 38 to the plate member 42. The spindle 48 has first sprockets 60 for receiving the first chain 50 of FIG. 1 and second sprockets 62 for receiving the second chain 52 of FIG. 1. Alternatively, the spindle 48 could be formed with grooves instead of sprockets and another type rotatable transfer device, such as belts, could be fitted within the grooves for rotation with the spindle 48 for driving vehicle components such as camshaft gears 32, 34.

The drive plate assembly 40 allows the balance transfer shaft 24 to be utilized not only to balance vibrational forces in the engine 12, but also to drive other vehicle systems. Furthermore, the front-end gear set (first gear 36 and second gear 38) achieves optimal backlash without reference to the location of the rear end gear set (gears 26 and 28), via a simplified assembly process in which the drive plate assembly 40 is preassembled and the balance transfer shaft bore is machined from the rear of the engine block 12 through to the front. Specifically, a method of assembling a powertrain (such as an engine assembly), described with respect to the embodiment of the engine assembly 11 shown in the drawings, includes mounting the first gear 36 and the second gear 38 to the plate member 42 such that the first and second gears 36, 38 intermesh. First gear 36 is mounted to plate member 42 by sliding a flange extension of first gear 36 within the flange portion 46 at opening 54 of plate member 42 (the end of the flange extension of first gear 36 is visible extending through the flange portion 46 around transfer shaft 24 in FIG. 2). A bearing may also be installed between the first gear 36 and the plate member 42. Second gear 38 is mounted to plate member 42 by sliding second gear 38 over flange portion 51. A bearing may also be installed between the gear 38 and flange portion 51. Thus, by mounting the first and second gears 36, 38 to the plate member 42, the drive plate assembly 40 is preassembled before it is mounted to the engine block 12. After mounting the gears 36, 38, the method includes mounting the plate member 42 to the engine block 12 so that the first gear 36 aligns with a rotatable drive member such as the balance transfer shaft 24 and the plate member 42 is at least partially supported by the engine block 12. The balance transfer shaft 24 can then power the second gear 38 via the first gear 36. The method of assembling a powertrain may include machining an opening through the engine block 12, such as an opening of bore 43, which may extend through the entire block 12. The rotatable drive member (balance transfer shaft 24) may be supported by the block 12 so that it extends through the opening. Mounting the plate member 42 may include piloting the first cylindrical flange portion 46 of the plate member 42 into the front opening of bore 43 in the engine block 12 and fastening the plate member 42 to the engine block 12 by attaching fasteners through the fastener openings 44.

While the best mode for carrying out the invention has been described in detail, those familiar with the art to which this invention relates will recognize various alternative designs and embodiments for practicing the invention within the scope of the appended claims.

The invention claimed is:

1. A drive plate assembly comprising:

a plate member adapted for mounting to an engine block;

first and second gears rotatably mounted with respect to said plate member such that the gears intermesh with one another, backlash of said gears thereby being predetermined by mounting of said gears to said plate member and unaffected by mounting of the plate member to the engine block;

wherein said drive plate has a first flange portion forming a first flange opening and configured to receive a rotatable shaft extending from said opening in said engine block; and wherein said first gear is mounted to said plate member concentric with said first flange opening wherein said plate member has a flange portion concentric with said second gear and at least partially supporting said second gear for rotation thereabout.

2. The drive plate assembly of claim 1, wherein said plate member is adapted for mounting to said engine block such that said first gear is concentric with an opening in said engine block for receiving driving power through said opening for driving said second gear.

3. The drive plate assembly of claim 1, wherein said plate member has a second flange portion; and wherein said second gear is mounted to said plate member concentric with said second flange portion.

4. The drive plate assembly of claim 3, wherein said plate member has a third flange portion concentric with said second flange portion; and wherein said second gear is supported for rotation about said third flange portion.

5. The drive plate assembly of claim 1, wherein said plate member has fastener openings for receiving fasteners for attachment to said engine block.

6. An engine assembly comprising:

an engine block having an opening for supporting a rotatable shaft;

a plate member adapted for mounting to said engine block;

first and second gears rotatably mounted with respect to said plate member such that the gears intermesh with one another; wherein said plate member is mounted to said engine block such that said first gear is substantially concentric with said rotatable shaft and said rotatable shaft powers said second gear via said first gear; backlash of said gears thereby being predetermined by mounting of said gears to said plate member and unaffected by mounting of the plate member to said engine block; and wherein said plate member has a flange portion concentric with said second gear and at least partially supporting said second gear for rotation thereabout.

7. The engine assembly of claim 6, wherein said plate member has a flange portion concentric with said first gear and configured to be concentric with and partially surround said rotatable shaft when said plate member is mounted to said engine block.

8. A method of assembling a powertrain comprising:

mounting a first gear and a second gear to a plate member such that said first and second gears intermesh;

machining an opening in an engine block;

extending a rotatable drive member through said opening such that said rotatable drive member is at least partially supported by said engine block;

after said mounting said first gear and said second gear to said plate member, mounting said plate member to said engine block such that said first gear aligns with said rotatable drive member for powering the second gear via the first gear;

wherein said mounting said plate member to said engine block includes:

piloting a flange portion of said plate member into said opening in said engine block; and fastening said plate member to said engine block.

* * * * *